US009450360B2

(12) United States Patent
Zhu et al.

(10) Patent No.: US 9,450,360 B2
(45) Date of Patent: Sep. 20, 2016

(54) ELECTRICAL CONNECTOR FOR MATING WITH TWO KINDS OF CONNECTOR INTERFACES

(71) Applicant: HON HAI PRECISION INDUSTRY CO., LTD., New Taipei (TW)

(72) Inventors: Qing-Man Zhu, Kunshan (CN); Chien-Chiung Wang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/259,398

(22) Filed: Apr. 23, 2014

(65) Prior Publication Data

US 2014/0322943 A1 Oct. 30, 2014

(30) Foreign Application Priority Data

Apr. 26, 2013 (CN) ..... 2013 1 0149137

(51) Int. Cl.
*H01R 27/00* (2006.01)
*H01R 12/72* (2011.01)

(52) U.S. Cl.
CPC ..... *H01R 27/00* (2013.01); *H01R 12/724* (2013.01)

(58) Field of Classification Search
CPC ..... H01R 27/00; H01R 12/724
USPC ..... 439/217, 218, 541.5, 631, 637, 660
See application file for complete search history.

(56) References Cited

U.S. PATENT DOCUMENTS

| | | | | |
|---|---|---|---|---|
| 3,955,875 | A * | 5/1976 | Petiot | H01R 12/7082 439/631 |
| 5,460,546 | A * | 10/1995 | Kunishi et al. | 439/631 |
| 5,474,472 | A * | 12/1995 | Niwa et al. | 439/607.08 |
| 6,099,351 | A * | 8/2000 | Wu | 439/607.43 |
| 6,120,322 | A * | 9/2000 | Ho et al. | 439/541.5 |
| 6,273,757 | B1 * | 8/2001 | David et al. | 439/607.13 |
| 6,273,759 | B1 * | 8/2001 | Perino | H01R 12/716 439/631 |
| 7,094,086 | B2 | 8/2006 | Teicher | |
| 7,361,059 | B2 | 4/2008 | Harkabi et al. | |
| 8,162,675 | B2 | 4/2012 | Regnier et al. | |
| 8,353,728 | B2 | 1/2013 | Wang et al. | |
| 2010/0203751 | A1 * | 8/2010 | Tsai | H01R 13/6658 439/222 |
| 2011/0034080 | A1 * | 2/2011 | Su et al. | 439/607.01 |

* cited by examiner

*Primary Examiner* — Amy Cohen Johnson
*Assistant Examiner* — Milagros Jeancharles
(74) *Attorney, Agent, or Firm* — Ming Chieh Chang; Wei Te Chung

(57) ABSTRACT

An electrical connector adapted for mating with a first kind or a second kind of mating connector including an insulative housing and a number of conductive terminals received in the insulative housing and arranged in a horizontal row. Each conductive terminal comprises a tail portion, a mating portion, and a middle portion between the tail portion and the mating portion, the mating portion including a first upper contact surface and a first lower contact surface opposite to the first upper contact surface.

3 Claims, 4 Drawing Sheets

ELECTRICAL CONNECTOR FOR MATING WITH TWO KINDS OF CONNECTOR INTERFACES

BACKGROUND OF THE INVENTION

1. Field of the Invention

The present invention generally relates to an electrical connector for mating with a selected one of two kinds of connector interfaces, and more particularly relates to a structure of the conductive terminals of the electrical connector.

2. Description of Related Art

U.S. Pat. No. 8,353,728, issued on Jan. 15, 2013, discloses a receptacle connector including a housing defining a slot, a first group of terminals, and a second group of terminals. The first group of terminals include a first terminal having a first contact portion disposed at a first side of the slot, a second terminal having a second contact portion, and a third terminal having a third contact portion disposed at a second side of the slot. The first contact portion is positioned between the second contact portion and the third contact portion along a mating direction. The second group of terminals include a fourth terminal and a fifth terminal. A mating connector including a paddle board has a first face and a second opposite face. A group of pads are set at a front of the first face, while two groups of pads are set at a front of the second face.

U.S. Pat. No. 8,162,675, issued on Apr. 24, 2012, discloses a receptacle connector comprising a mating face. The mating face has two circuit card-receiving slots for receiving a mating connector that includes two paddle boards.

U.S. Pat. No. 7,361,059, issued on Apr. 22, 2008, discloses an electrical connector comprising a flexible tongue and a plurality of contacts on both sides of the flexible tongue. When the electrical connector is mating with a mating connector, the contacts on one side of the flexible tongue connect with the mating connector; when mating with the mating connector that is inverted, the contacts on the other side connect with the inverted mating connector.

U.S. Pat. No. 7,094,086, issued on Aug. 22, 2006, discloses a reversible connector for coupling with a USB A-type standard connector, including a first set of four electrical contact regions and a second set of four electrical contact regions. The contact regions are so configured that in a first coupling orientation of the reversible connector with the standard connector, only the first set of electrical contact regions is mechanically connected with the contacts of the standard connector and in a second coupling orientation, only the second set of electrical contact regions is mechanically connected with the contacts of the standard connector.

An electrical connector having a different arrangement of the contacts or terminals is desired.

SUMMARY OF THE INVENTION

Accordingly, an object of the present invention is to provide an electrical connector of a simple structure for mating with two kinds of mating connectors.

In order to achieve the above-mentioned object, an electrical connector for mating with a selected one of two kinds of connector interfaces comprises an insulative housing; and a plurality of conductive terminals received in the insulative housing, each conductive terminal comprising a tail portion, a mating portion, and a middle portion between the tail portion and the mating portion, the conductive terminals comprising a plurality of first conductive terminals arranged in a horizontal direction, the mating portion of each of the first conductive terminals comprising a first upper contact surface and a first lower contact surface opposite to the first upper contact surface, the first upper contact surface being designed for mating with a first kind of connector interface, the first lower contact surface being designed for mating with a second kind of connector interface.

According to the present invention, four groups of the conductive terminals form three slots for mating with two kinds of mating connectors.

Other objects, advantages and novel features of the invention will become more apparent from the following detailed description when taken in conjunction with the accompanying drawings.

DETAILED DESCRIPTION OF THE PREFERRED EMBODIMENT

Figure 1:
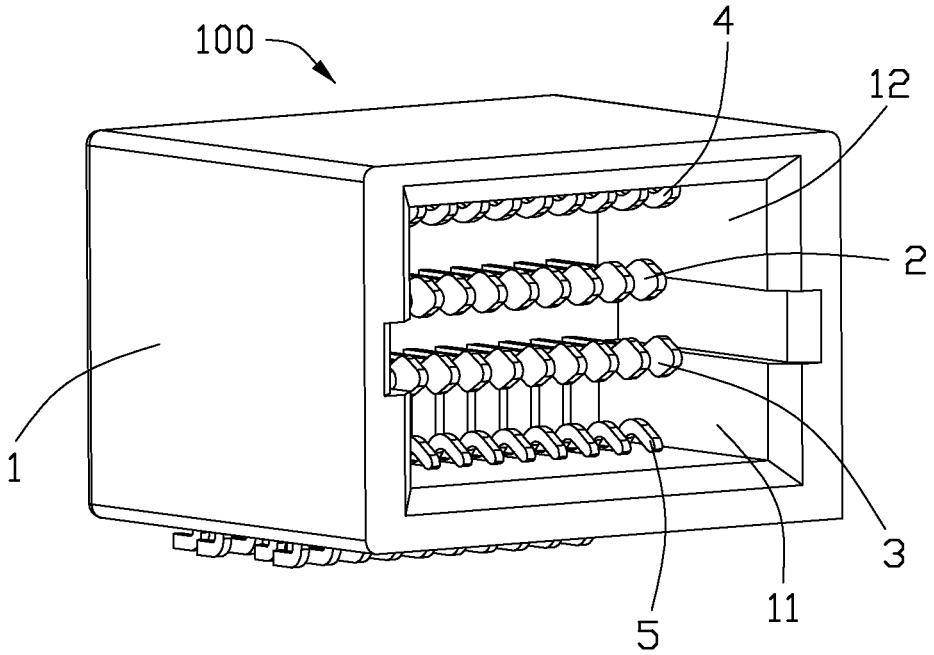
FIG. 1 is a perspective view of an electrical connector in accordance with the present invention.

Reference will now be made to the drawing figures to describe the present invention in detail.

Figure 3:
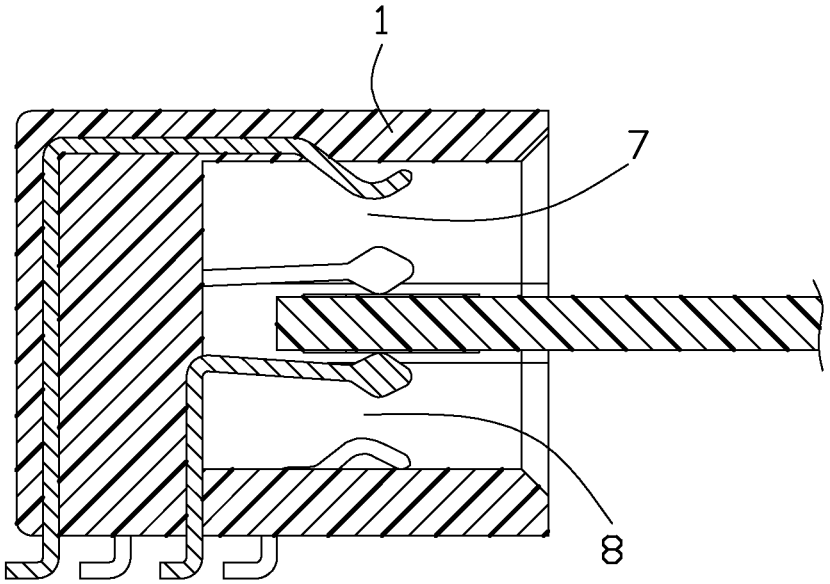
FIG. 3 is a cross-sectional view of the electrical connector as shown in FIG. 1 mated with a first kind of mating connector.
Figure 4:
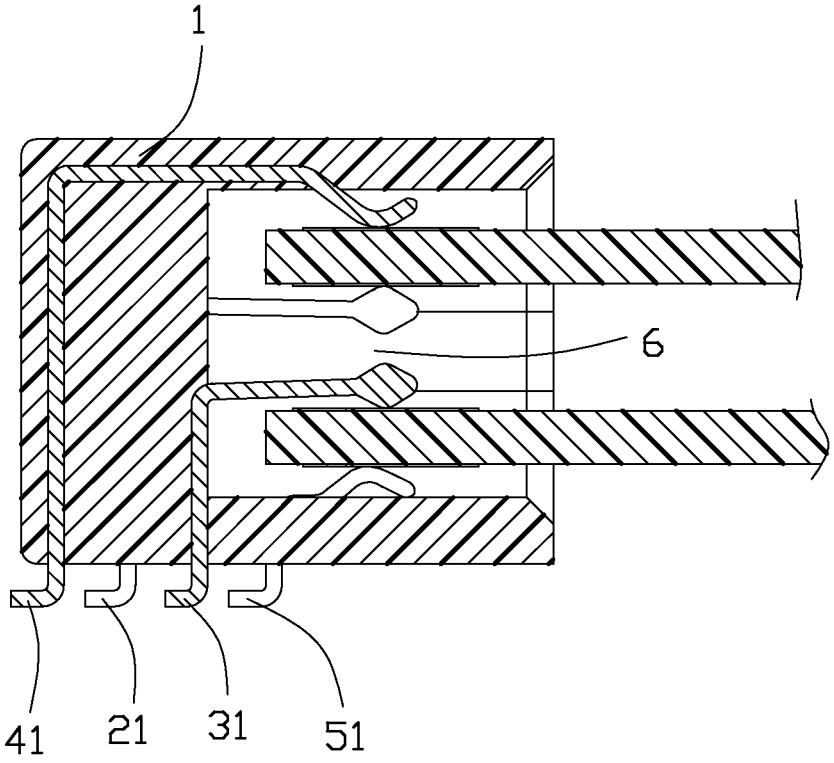
FIG. 4 is a cross-sectional view of the electrical connector as shown in FIG. 1 mated with a second kind of mating connector.

Referring to FIGS. 1, 3, and 4, an electrical connector 100 adapted for mating with a first kind or a second kind of mating connector is shown. The first kind of mating connector has one circuit board while the second kind of mating connector has two circuit boards spaced apart from each other along a vertical direction. The electrical connector 100 comprises an insulative housing 1 and a plurality of conductive terminals 2,3,4,5 received in the insulative housing 1.

The insulative housing 1 comprises a mating interface 11 and a cavity 12 for receiving the conductive terminals 2,3,4,5.

Figure 2:
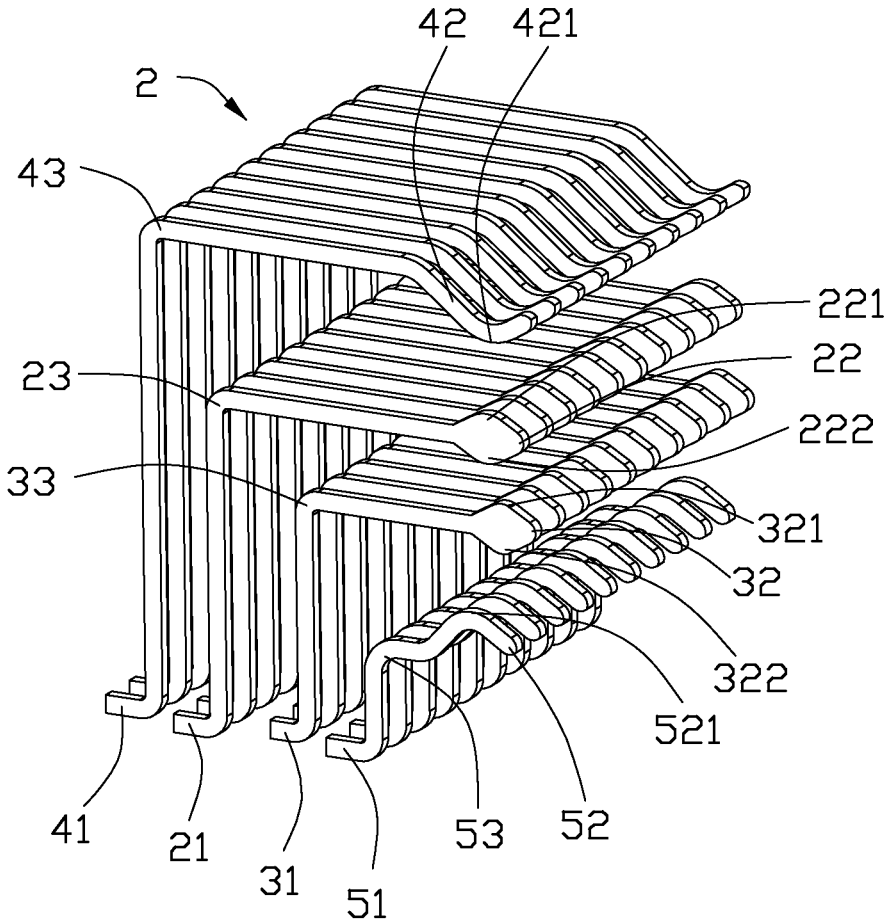
FIG. 2 is a partly exploded view of the electrical connector as shown in FIG. 1.

Referring to FIG. 2, the conductive terminals 2,3,4,5 comprise a plurality of first conductive terminals 2 arranged in a horizontal direction, a plurality of second conductive terminals 3 arranged in the horizontal direction and disposed below the first conductive terminals 2 in a vertical direction, a plurality of third conductive terminals 4 arranged in the horizontal direction and disposed above the first conductive terminals 2, and a plurality of fourth conductive terminals 5 arranged in the horizontal direction and disposed below the second conductive terminals 3. In other embodiment, the second conductive terminals 3 can be disposed above the first conductive terminals 2 so that the third conductive terminals 4 are disposed above the second conductive terminals 3 and the fourth conductive terminals 5 are disposed below the first conductive terminals 2.

Each of the third conductive terminals 4 is so arranged as to be aligned with the corresponding one of the second conductive terminals 3 in a vertical direction, and each of the first conductive terminals 2 is also aligned with a corresponding fourth conductive terminal 5 in the vertical direction. Each of the first conductive terminals 2 is staggered with a corresponding third conductive terminal 4 in the vertical direction, and each of the second conductive terminals 3 is also staggered with a corresponding fourth conductive terminal 5 in the vertical direction.

Each conductive terminal 2,3,4,5 comprises a tail portion 21,31,41,51 extending beyond the insulative housing 1 for being installed on an external device, a mating portion 22,32,42,52, and a middle portion 23,33,43,53 therebetween. The tail portion 21,31,41,51 is designed as surface mounted type. The mating portion 22,32,42,52 is set as a right angle to the tail portion 21,31,41,51.

Referring to FIGS. 3 and 4, the middle portions 23,33, 43,53 are retained in the insulative housing 1 to make the conductive terminals 2,3,4,5 stable so that the conductive terminals 2,3,4,5 will not easily deform when connected.

Each of the first conductive terminals 2 comprises the tail portion 21, the mating portion 22, and the middle portion 23 connecting the tail portion 21 and the mating portion 22. The mating portion 22 of the first conductive terminals 2 comprises a first upper contact surface 221 projecting upwardly and a first lower contact surface 222 projecting downwardly opposite to the first upper contact surface. The first upper contact surface 221 mates with the second kind of mating connector when connected with one kind of the mating connector, and the first lower contact surface 222 mates with the first kind of the mating connector when connected with the other kind of mating connector.

Each of the second conductive terminals 3 comprises the tail portion 31, the mating portion 32, and the middle portion 33 connecting the tail portion 31 and the mating portion 32. The mating portion 32 of the second conductive terminals 3 comprises a second upper contact surface 321 projecting upwardly for mating with the first kind of the mating connector and a second lower contact surface 322 projecting downwardly for mating with the second kind of the mating connector.

Each of the third conductive terminals 4 comprises the tail portion 41, the mating portion 42, and the middle portion 43 connecting the tail portion 41 and the mating portion 42. The mating portion 42 of the third conductive terminals 4 comprises a third contact surface 421 projecting downwardly for mating with the second kind of mating connector.

Each of the fourth conductive terminals 5 comprises the tail portion 51, the mating portion 52, and the middle portion 53 connecting the tail portion 51 and the mating portion 52. The mating portion 52 of the fourth conductive terminals 5 comprises a fourth contact surface 521 projecting upwardly for mating with the second kind of mating connector.

A first slot 6 is formed between the first conductive terminals 2 and the second conductive terminals 3. A second slot 7 is formed between the first conductive terminals 2 and third conductive terminals 4. And a third slot 8 is formed between the second conductive terminals 3 and the fourth conductive terminals 5.

When the electrical connector 100 mates with the first kind of mating connector, the only one circuit board is inserted into the first slot 6 from the mating interface 11. When the electrical connector 100 mates with the second kind of mating connector, the circuit boards are inserted into the second slot 7 and the third slot 8, respectively. An alternative embodiment may convert the two rows of contacts 2 and 3 into only one row to be deflectable between two slots 7 and 8, and the connection interfaces in the slots 7 and 8 are different from each other.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector comprising:

an insulative housing defining opposite first and second mating ports both forwardly communicating with an exterior in a front-to-back direction;

a plurality of first contacts disposed in the housing along a transverse direction, which is perpendicular to said front-to-back direction, with forwardly extending first contacting sections exposed in the first mating port;

a plurality of second contacts disposed in the housing along said transverse direction with forwardly extending second contacting sections exposed in the second mating port; and a plurality of third contacts disposed in the housing along said transverse direction with forwardly extending third contacting sections exposed in both the first and second mating ports; wherein the first contacts cooperate with the third contacts to mate with a first complementary part received in the first mating port while the second contacts cooperate with the third contacts to mate with a second complementary part received in the second mating port in a mutually exclusive manner.

2. The electrical connector as claimed in claim 1, wherein the first mating port and the second mating port are spaced from each other in a vertical direction perpendicular to both said front-to-back direction and said transverse direction.

3. The electrical connector as claimed in claim 1, wherein a thickness direction of each of the third contacts extends in the transverse direction.

* * * * *